United States Patent [19]

Bjorklund et al.

[11] 4,295,351

[45] Oct. 20, 1981

[54] SELF-TAPPING STAINLESS STEEL SCREW AND METHOD FOR PRODUCING SAME

[75] Inventors: Lowell L. Bjorklund, Elgin, Ill.; Ramon A. Berg, Hales Corners, Wis.; Henry A. Sygnator, Arlington Heights, Ill.

[73] Assignee: Illinois Tool Works Inc., Chicago, Ill.

[21] Appl. No.: 1,975

[22] Filed: Jan. 8, 1979

[51] Int. Cl.[3] ..... B21H 3/06; B21K 1/56

[52] U.S. Cl. ..... 72/38; 10/10 R; 72/88; 72/364; 72/700; 148/125; 411/411

[58] Field of Search ..... 10/10 R, 27 R, 27 H; 72/88, 90, 342, 364, 700, 38; 148/125, 147; 85/1 C, 48, 41, 1 R; 411/411

[56] References Cited

U.S. PATENT DOCUMENTS

| | | | |
|---|---|---|---|
| 3,357,868 | 12/1967 | Tanczyn | 148/12.3 |
| 3,376,780 | 4/1968 | Tanczyn | 85/48 |
| 3,517,402 | 6/1970 | Cohen | 10/27 R |
| 3,924,508 | 12/1975 | De Caro | 85/41 |
| 4,042,421 | 8/1977 | Van den Sype et al. | 148/125 X |
| 4,042,423 | 8/1977 | Van den Sype et al. | 148/125 X |
| 4,083,220 | 4/1978 | Kobayashi et al. | 72/364 |

FOREIGN PATENT DOCUMENTS

| | | | |
|---|---|---|---|
| 477874 | 10/1951 | Canada | 148/125 |
| 477875 | 10/1951 | Canada | 148/125 |
| 2311214 | 12/1976 | France | 85/1 C |
| 462646 | 5/1975 | U.S.S.R. | 72/90 |

*Primary Examiner*—Ervin M. Combs
*Attorney, Agent, or Firm*—Richard K. Thomson; Thomas W. Buckman

[57] ABSTRACT

A process for producing self-tapping screws from an austenitic 300 series stainless steel material wherein a blank of such material is chilled prior to a thread rolling operation so that the threads are formed while the blank is in a chilled condition. A preferred apparatus for practicing such a method utilizes an insulated tunnel surrounding the feed track which leads to the thread roller. Fluid refrigerant is fed to the interior of the tunnel to chill the blanks immediately prior to the thread rolling operation.

5 Claims, 8 Drawing Figures

SELF-TAPPING STAINLESS STEEL SCREW AND METHOD FOR PRODUCING SAME

BACKGROUND OF THE INVENTION

This invention relates generally to the art of producing self-tapping threaded fasteners and more particularly to the art of producing such fasteners from a stainless steel material.

A type of stainless steel material, namely 300 series, has for many years been the primary material utilized for producing highly corrosive-resistant devices, such as threaded fasteners. However, such a material, which is typically referred to as 18-8 stainless steel, referring to the percentages of chromium and nickel-like components, are austenitic and nonheat-treatable. Thus, these materials have been confined to usages where high hardness levels are not required. In the environment of self-tapping screws, it is apparent that such hardness levels are required and typically a range of hardness of 45–50 $R_C$ is necessary in order to tap or form threads in a carbon steel workpiece.

There have been numerous attempts to provide a stainless steel material with the hardness necessary to perform adequately in a tapping environment. Typical of such attempts are the use of a 400 series stainless which is, at most, 12% chromium. Such material is heat-treated and quenched to relieve stresses and then reheated to a moderate temperature. This produces a fastener which is hardened throughout in hardness ranges sufficient to tap but with a tendency to become brittle. However, since the chromium content is limited to 12%, such materials are not as corrosive-resistant as the 300 series, 18-8 material.

Other attempts to provide a heat-treatable characteristic to a stainless material with higher chromium content involve the use of precipitation hardening agents, such as titanium or columbium in the chemistry of the steel with subsequent age hardening steps. These techniques, however, tend to deplete the effective chromium and are, at most, a compromise solution.

Stainless steels which include 18% chromium and 18% of a nickel-type material are available and have been found to be hard enough to function in many tapping environments. However, this material is difficult to cold-head and thread roll because of its inherent hardness causing very short tool life in both such operations.

Other attempts to provide a complex treatment for the steel by heating or the addition of components, such as aluminum and critical quantities of chromium, nickel and carbon have been attempted. All of which appear to be expensive and difficult to utilize in a high production fastener manufacturing situations again appear to provide only a compromise solution.

SUMMARY OF THE INVENTION

It is an object of the invention to provide a method and an apparatus for practicing said method which will produce threaded fasteners capable of performing in a tapping environment and which are made from a 300 series, 18-8 stainless steel material.

Another object of the invention is to provide a method and apparatus for producing a self-tapping fastener from 300 series austenitic stainless steel material which does not involve extensive or complex heat treating or hardening steps or operations.

Still a further object of the invention is to provide a method and preferred embodiment of an apparatus for producing self-tapping fasteners from a 300 series austenitic material without relying on specially designed complex chemical compositions to produce a material which is heat-treatable or hardenable after the fastener has been produced.

Still a further object and advantage of the invention is the ability to use the process in a somewhat conventional thread rolling operation with minor modifications.

These and other objects and advantages of the invention are provided by the process and apparatus described herein which contemplates the chilling of a 300 series, austenitic, 18-8, stainless steel, headed blank prior to the thread rolling operation so that the blank is rolled while in the chilled condition. It is contemplated that the range of actual chilling to practice this invention should be significantly less than the ambient temperature and it has been found that a range of −40° F. to −200° F. produce acceptable products.

In practicing this invention, threaded products have been attained which have a hardness at the crests and roots of approximately 45–50 $R_C$ and hardness at the core of generally 30 $R_C$.

A preferred embodiment of an apparatus for practicing the invention will be shown to consist of an insulated tunnel-like enclosure around a feed rail leading to a pair of reciprocating thread rolling dies. A flow of liquid refrigerant, such as liquid nitrogen, is provided at selected points within the tunnel to the blanks and feed rail.

The above objects, advantages, features and description of the invention will be more readily understood by reference to the following detailed description and accompanying drawings.

DESCRIPTION OF THE PREFERRED EMBODIMENT

The present invention creates a threaded fastener capable of tapping or forming mating threads in a carbon steel material operations. The invention more particularly describes a process and apparatus for producing such a fastener from an austenitic 300 series stainless steel material which heretofore has been desirable for threaded fasteners because of its highly corrosive resistant properties but ineffective for use as a tapping screw.

300 series stainless steel which is typically an 18-8 composition and which more particularly has the following chemistry has been utilized in the invention with acceptable results; 17-18.5% chromium, 7.75-8.25% nickel, 0.06-0.10% carbon, 2.0% manganese, 1.0% silicon and approximately 0.045% phosphorus and 0.030% sulfur.

Material of this type of chemistry in wire form is first headed as in conventional cold heading techniques to produce a fastener blank. After the heading operation, the blank is chilled substantially below ambient temperature and it has been found that blanks chilled to temperatures from −40° F. to −200° F. are sufficient to practice the invention. With the blanks in the chilled condition, they are fed into a conventional thread rolling apparatus so that threads are formed thereon while in said chilled condition. It is believed that the aggressive cold working of the 300 series, austenitic material, by thread rolling, while in a significantly chilled condition, converts austenite to martensite at least in the crest and root areas of the thus formed screw which produced a hardness level in those regions sufficient to tap.

After the thread rolling procedure, the blanks are then handled in a conventional manner. Thus, the invention is capable of producing a self-tapping screw from a heretofore unhardenable but highly corrosive-resistant material while utilizing procedures and equipment conductive to high production rates. For example, the thread rolling apparatus and techniques utilized by the invention may produce hardened threaded fasteners with rates anywhere in the range of 40 pieces per minute to 400 pieces per minute depending upon the particular speed of the thread machine.

Figure 3:
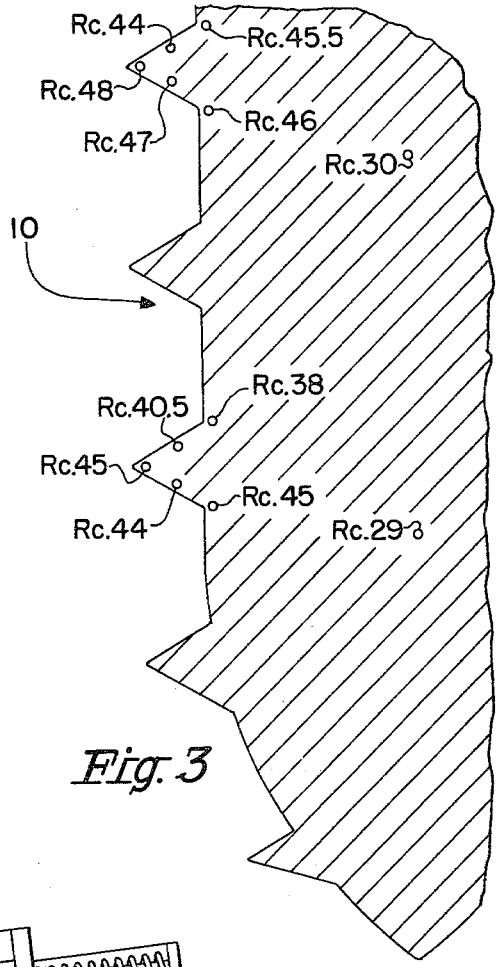
FIG. 3 is an enlarged partial sectional view of the fastener shown in FIG. 2 illustrating the various hardness levels produced by the invention.
Figure 2:
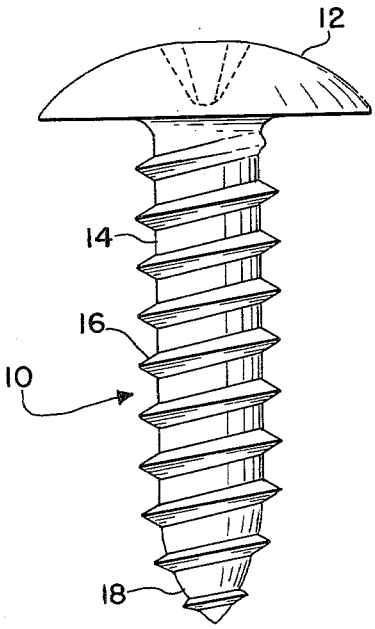
FIG. 2 is a side elevational view of a self-tapping fastener produced in accordance with the invention.

Turning first to FIGS. 2 and 3, a typical fastener produced by the method and apparatus described herein will be shown. It should be understood that the fastener shown herein is not meant to limit the invention to the production of a particular fastener but is only representative of the configuration of a fastener that may be produced utilizing the invention.

The fastener 10 may typically be one with a head 12 and shank 14 having spaced threads 16 formed thereon and, in the preferred embodiment, a generally conical, threaded point 18.

Turning to FIG. 3, it will be shown that the process of chilling an austenitic 300 series, stainless steel blank so that the thread rolling procedure is performed on a substantially chilled blank produces hardness levels which heretofore were unavailable with 18-8 stainless steel. For example, the roots and crests of threads of several samples were in the range of 45-50 $R_C$, with the flanks of the threads being about 40 $R_C$ and the core of the shank itself being generally a minimum hardness of about 30 $R_C$. The fastener 10 thus has the necessary hardness in the root and crest to prevent thread rollover but also has a certain amount of ductility. The process produces a fastener which is not hardened throughout and therefore not brittle and can thus withstand high tensile and shear loads. It should be noted that the hardness readings shown in FIG. 3 are illustrative of the range of hardness obtainable by this process and not meant to limit the invention thereto.

It has been found in developing the invention that there is a certain correlation between the magnetism of the finished screw and the hardness of the screw and it is believed that this is due to the transformation from austenite to martensite during the thread rolling while in the chilled condition.

Figure 1:
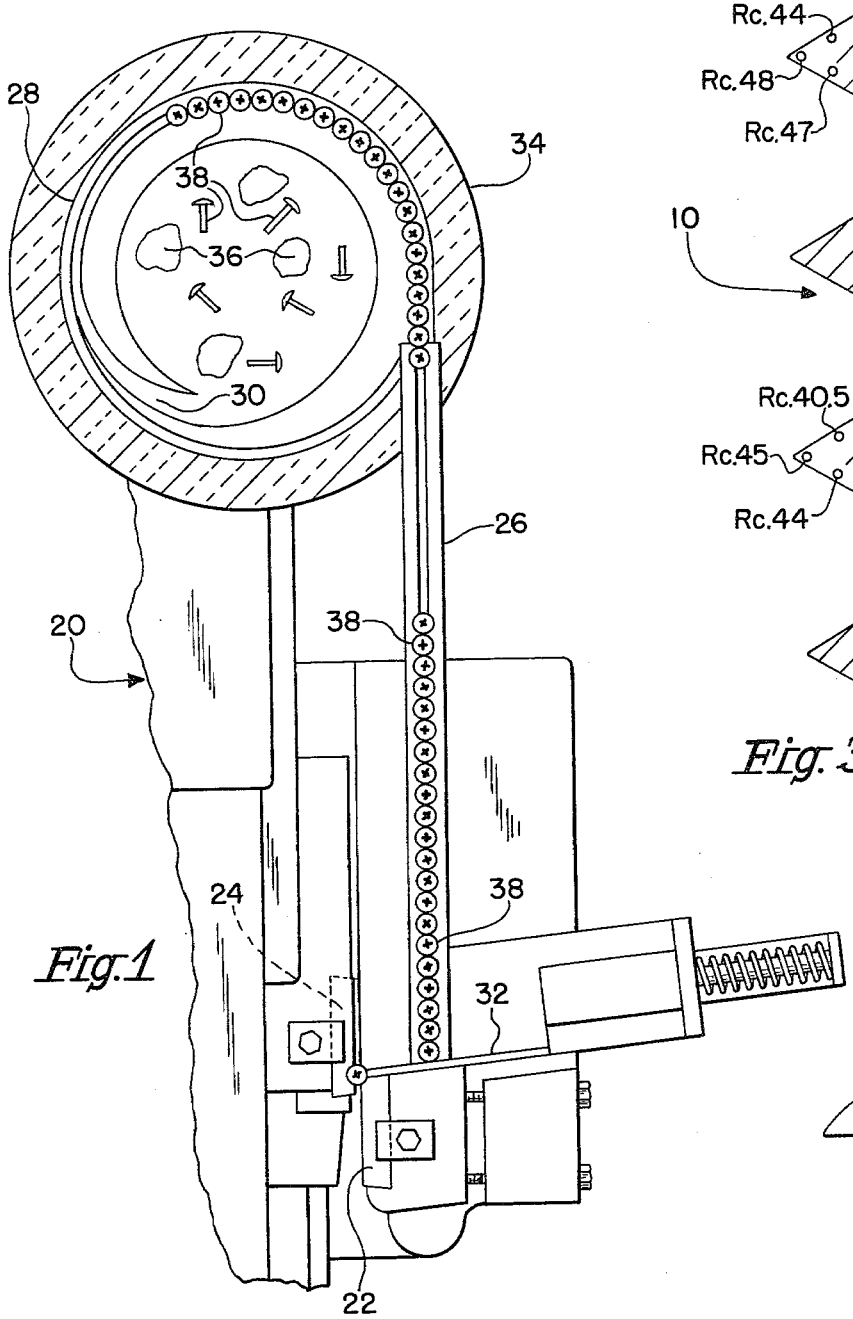
FIG. 1 is a top plan view of an apparatus for practicing the invention.

Turning now to FIG. 1, one manner of practicing the invention by using somewhat standard thread rolling and feeding equipment will be shown. A conventional thread rolling machine 20 with a fixed die 22 and a moving die 24 with an integral feed rail 26 leading to the mouth of the reciprocating die set is equipped with a vibratory blank hopper 28. The hopper in a conventional manner will include a spiral-type feed track 30 to produce a succession of blanks from the supply in the hopper to the feed rail 26. As in conventional practice, some escapement means 32 is provided at the lowermost end of the inclined feed rail to reliably feed each successive blank into the thread rolling die members.

One technique of chilling the blanks prior to thread rolling involves controlling the temperature with the hopper 28 through the use of an insulating wall 34 around the hopper. The blanks are chilled therein by depositing a cooling medium, such as dry ice 36, within the hopper 28. It has been found that an insulated hopper which holds the dry ice with the 300 series stainless steel blanks positioned therein is sufficient to cool the environment in the hopper to at least −100° F.

The thus chilled blanks are then fed, as in conventional practice, from the hopper to the uppermost extremity of the feed rail and gravity fed by inclined rail 26 into the mouth of the thread rolling dies. It has been found that the temperature of blanks at the vicinity of escapement means 32 are in the range of about −40° F. when cooled using this technique.

It should be understood that many alternative manners of practicing the invention and chilling the blanks and feeding the blanks can be utilized and still come within the broad scope of this invention.

Figure 4:
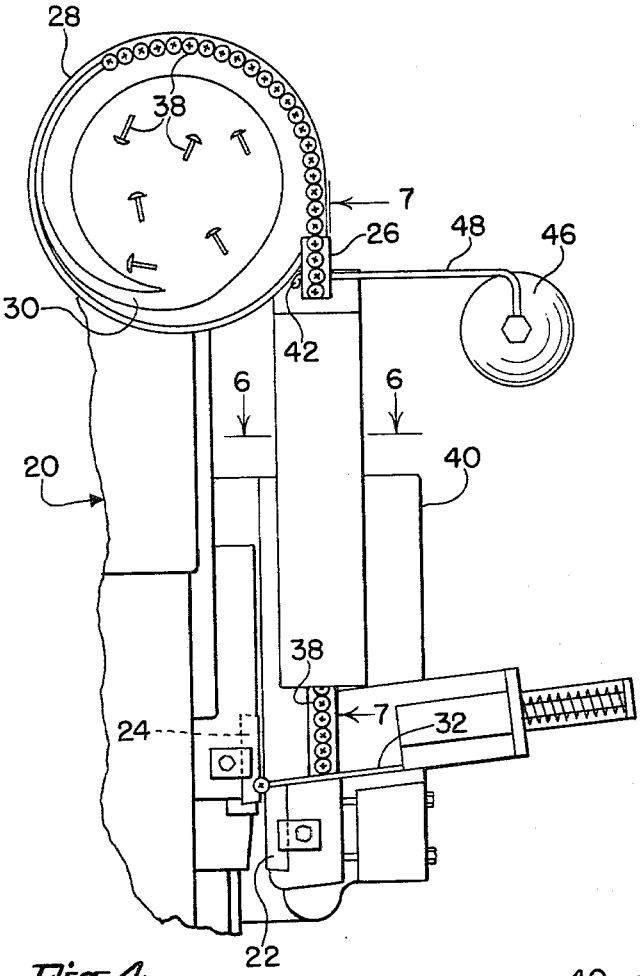
FIG. 4 is a top plan view of an alternate embodiment of an apparatus for practicing the invention.
Figure 5:
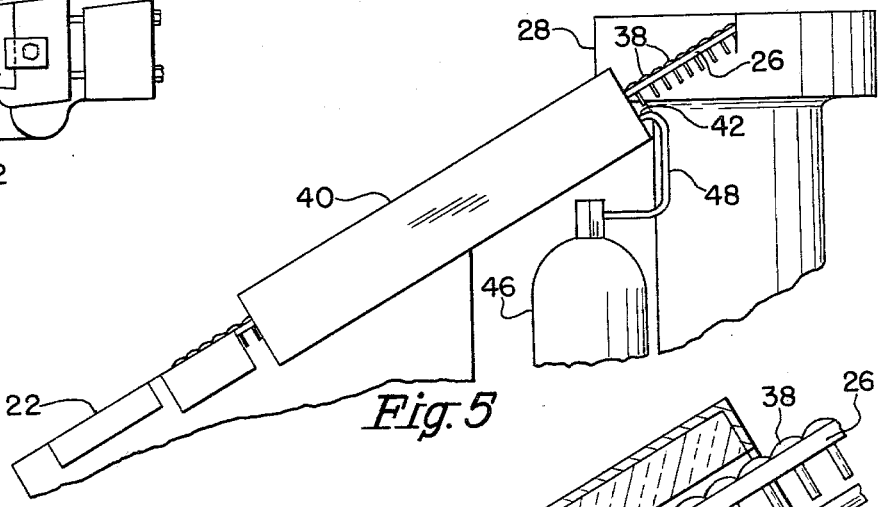
FIG. 5 is a side elevational view of the apparatus shown in FIG. 4.

For example, as shown in FIGS. 4 and 5 an insulating tunnel 40 may be provided around a feed rail 26. The other elements of the thread rolling apparatus 20 will be essentially the same as that shown in FIG. 1 without the chilling and insulation of the hopper 28.

Figure 6:
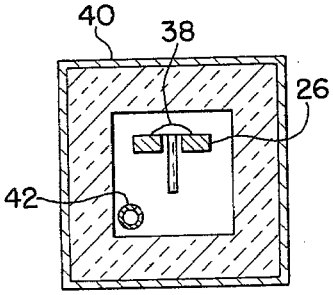
FIG. 6 is a cross section of the tunnel of the invention taken along the lines 6—6 of FIG. 4.
Figure 7:
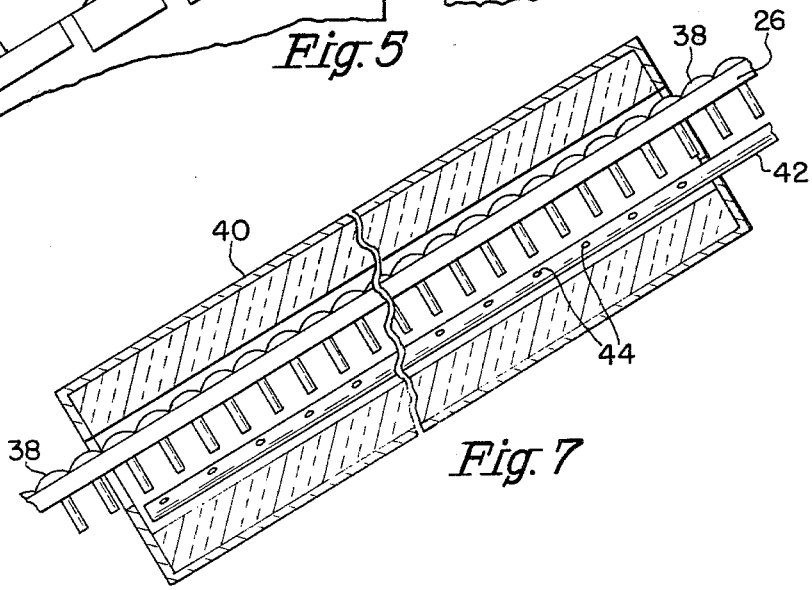
FIG. 7 is a cross-sectional view of the tunnel of the invention taken along the lines of 7—7 of the apparatus shown in FIG. 4.

The tunnel 40 will surround and isolate a major extent of the feed rail 26 from the ambient temperature. In such an isolated environment, directly adjacent the mouth of the thread rolling dies 22 and 24, a source of the fluid refrigerant is provided, to spray the blanks 38 and feed rail 26. It has been found that spraying of the blanks 38 in the tunnel 40 with feed tube 42 provided with a series of spaced orifices 44 sufficiently cools the environment within the tunnel in a temperature range of upwards −200° F. Tube 42 will be connected to a source for refrigerant, preferably liquid nitrogen. Thus refrigerant tanks 46 and necessary feed line 48 are positioned adjacent the thread rolling apparatus. The feed tube 42 as shown in FIGS. 6 and 7, may be positioned lengthwise in the tunnel adjacent the feed rail so that one or more of the orifices 44 serve as jets to spray the internal area of the tunnel and more particularly the blanks. This closed environment which retains the very low temperature in the tunnel has proven to reliably provide chilled blanks sufficient to achieve the change from austenitic to martensitic structure during the cold working of the thread rolling.

Figure 8:
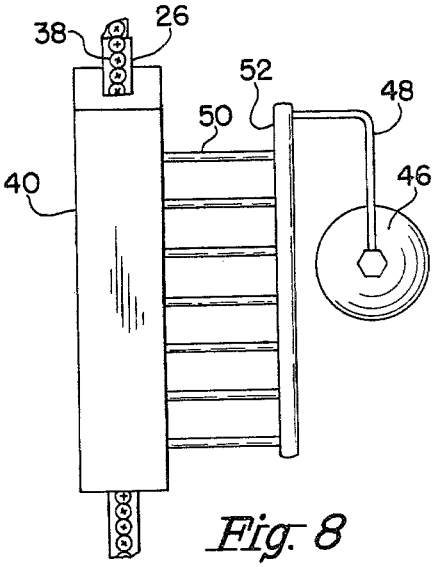
FIG. 8 is a partial top-plan view of an alternate embodiment of the apparatus shown in FIG. 4.

Using the basic concept of the apparatus including an insulating tunnel shown in FIGS. 4 and 5, it would be apparent that any number of techniques can be utilized to the tunnel. For example, FIG. 8 shows a series of nozzles 50 connected to an external manifold 52, with the nozzles penetrating the walls of the tunnel in selected spaced locations therealong. As in the embodiment of FIGS. 4–7, the manifold is connected to a liquid or fluid refrigerant supply, such as liquid nitrogen.

The invention and apparatus as described herein are thus sufficient to produce a self-tapping screw from a 300 series, 18-8, stainless steel material in a manner which hereinbefore was not possible. The process, thus, can utilize somewhat standard chemistry of 300 series stainless material having its advantageous, highly corrosive-resistant properties and relative ease of heading and working and yet achieve high hardness at the crest and roots of the threads for self-tapping screws. The process and apparatus, as will be apparent from the description above, can be utilized in relatively conventional threaded product producing equipment and without requiring extensive preparation of the blank or post threading processes and therefore is adaptable for efficient high production rate techniques. While the reasons for the unique results of this invention are not entirely clear, it is assumed that the high hardness on a previously unhardenable stainless steel material is achieved by a combination of work hardening and change from austenite to martensite resulting from aggressively working the blank in thread rolling while the blank is in a chilled condition.

We claim:

1. A process for producing a threaded, self-tapping screw with a thread hardness in the range of RC 45–50 while its core retains a hardness in the area of RC 30, said screw being made from an austenitic 300 series nickel-chromium stainless steel material said method including the steps of forming a headed blank with a shank portion from said 300 series material, chilling at least the shank portion of the thus formed austenitic blank to a temperature substantially below 0° F., rolling the blank between thread-rolling dies forming threads on said shank portion while the blanks are in the chilled condition, said thread-rolling step causing sufficient localized transformation of the material in the region of the threads to martensite to produce the RC 45–50 hardness without substantial effect on a central core portion of said threaded shank.

2. The process of claim 1, wherein the blanks are chilled to at least −40° F.

3. The process of claim 1, wherein the blanks are of material which generally include 16–19% chromium and 6–8.5% nickel.

4. The process of claim 1, wherein the blanks are chilled in a hopper prior to feeding each blank into the thread rolling operation.

5. The process of claim 1, wherein the blanks are chilled generally to the range of −100° F. to −200° F. prior to the thread rolling operation.

* * * * *